US005561717A

United States Patent [19]

Lamm

[11] Patent Number: 5,561,717

[45] Date of Patent: Oct. 1, 1996

[54] LOUDSPEAKER SYSTEM

[75] Inventor: Michael E. Lamm, High Ridge, Mo.

[73] Assignee: American Trading and Production Corporation, Baltimore, Md.

[21] Appl. No.: 212,769

[22] Filed: Mar. 15, 1994

[51] Int. Cl.[6] ..... H04R 1/02

[52] U.S. Cl. ..... 381/89

[58] Field of Search ..... 381/89, 154, 159, 381/90, 182, 190; 181/153, 156, 189, 190, 196, 197, 199

[56] References Cited

U.S. PATENT DOCUMENTS

| | | | |
|---|---|---|---|
| 3,945,461 | 3/1976 | Robinson | 181/153 |
| 4,016,953 | 4/1977 | Butler | 381/89 |
| 4,391,346 | 7/1983 | Murakami et al. | 181/199 |
| 4,549,631 | 10/1985 | Bose | 181/155 |
| 4,836,326 | 6/1989 | Wehner | 181/153 |
| 4,891,842 | 1/1990 | Green | 381/152 |
| 4,932,060 | 6/1990 | Schreiber | 381/24 |
| 5,025,473 | 6/1991 | Carlsen | 381/89 |
| 5,025,885 | 6/1991 | Froeschle | 181/156 |
| 5,033,577 | 7/1991 | Veranth | 181/145 |
| 5,073,945 | 12/1991 | Kageyama | 381/89 |
| 5,092,424 | 3/1992 | Schreiber et al. | 181/145 |
| 5,097,514 | 3/1992 | McNeill | 181/199 |
| 5,119,431 | 6/1992 | Hamby | 381/89 |
| 5,253,301 | 10/1993 | Sakamoto et al. | 381/159 |

FOREIGN PATENT DOCUMENTS

| | | | |
|---|---|---|---|
| 2656548 | 6/1978 | Germany | 381/89 |
| 0284199 | 12/1986 | Japan | 381/190 |

*Primary Examiner*—Edward L. Coles, Sr.
*Assistant Examiner*—Jerome Grant, II
*Attorney, Agent, or Firm*—Cohn, Powell & Hind, P.C.

[57] ABSTRACT

This loudspeaker system intended primarily for woofers includes an enclosure (10) and a plurality of loudspeakers (16), each loudspeaker including a driver (18) having an axis, with the loudspeakers (16) being mounted in the enclosure (10) such that the axes of the drivers are arranged relative to each other to neutralize the vibration of the speakers.

2 Claims, 2 Drawing Sheets

LOUDSPEAKER SYSTEM

BACKGROUND OF THE INVENTION

This invention relates generally to loudspeaker systems and particularly to a system in which the loudspeakers are arranged in an enclosure in such a fashion as to minimize vibration of the enclosure.

The vibrational forces caused by the loudspeaker cone excursion are greatest for the lower frequencies. For example, if the cone is moving a quarter of an inch at 60 Hz., the cone assembly is being subjected to an acceleration of 49.3 gees. Common in the prior art is a loudspeaker system for low frequency reproduction, generally known as a subwoofer, including an enclosure with a single driver or two drivers mounted side by side. This unit can be free standing or it may be mounted in the ceiling, floor or walls. The loudspeaker cone assembly is mounted in one wall of the enclosure and moves in one direction causing an equal and opposite force to act upon the loudspeaker enclosure. When a subwoofer is mounted in the enclosure, these forces are of a great magnitude since subwoofers are responsive to the lower acoustic frequencies and the larger the loudspeaker, the greater the vibrations due to the greater mass and longer piston stroke.

One major disadvantage to this loudspeaker assembly is the excessive and unwanted vibration in and to adjoining rooms. Loudspeaker enclosures generally weigh much more than the cone assembly and are usually made of solid material, such as wood, in which sound travels more efficiently, faster and further. The enclosure does not move so far but there is as much total energy in the enclosure as in the cone assembly. When a wooden enclosure is attached to the frame of a house, the vibrations from the lower frequencies are easily transmitted through the entire house without the higher frequencies being heard. Since many people enjoy the aesthetics of a speaker system that is recessed, these people are left with a system that vibrates throughout the house and disturbs other people.

Also with prior art loudspeaker systems, the enclosure is normally placed in out of way places such as in corners, on top of bookshelves or behind drapes because with the excessive vibrations the enclosure is unable to serve other functions, for example, as an end table or a lamp stand. If an object is placed on these enclosures, the object will move or walk across the surface.

The ported system is a prior art approach which improves upon the acoustic suspension system and such a system is disclosed in U.S. Pat. No. 4,549,631. In the ported system there is an enclosure, a woofer and a port tube that can be used to alter the frequency response. In this system, the mass of air in the port reacts with the volume of air in the enclosure to create a port resonance and at the port resonance, the loudspeaker cone excursion is reduced. With this system there are still vibrations, especially at the lower frequencies, and the enclosure is unable to serve other functions such as an end table.

The present invention solves these and other problems in a manner not disclosed in the known prior art.

SUMMARY OF THE INVENTION

This loudspeaker system has the particular advantage that the cone assembly is arranged in the enclosure to minimize, or even neutralize, the excessive vibration so common in subwoofer assemblies. The enclosure can be freestanding or recessed in the walls, floor or ceiling providing a vibrationless enclosure. When freestanding, the enclosure can serve other functions such as provide a vibration free cabinet. When recessed within a room, it eliminates vibrations throughout the house and does not disturb people in other rooms.

Another advantage is that the invention solves the problem of unwanted vibration by geometric arrangement of the loudspeakers within an enclosure rather than by an electronic solution.

It is an aspect of this invention to provide a loudspeaker system comprising enclosure means and a plurality of loudspeakers each including a driver having an axis with the loudspeakers being mounted in the enclosure such that the axes of the drivers are arranged relative to each other to neutralize the vibration of the enclosure. It is another aspect of this invention that the vector sum of the driver forces is zero.

It is another aspect of this invention to provide a loudspeaker system in which a pair of loudspeakers is provided and the axes of the drivers are coaxial.

It is yet another aspect of this invention to provide a loudspeaker system in which at least three loudspeakers are provided, and the axes of said drivers intersect at a point.

Still another aspect of this invention is to provide a loudspeaker system in which the enclosure means includes at least a pair of spaced walls and means connecting said walls, and a loudspeaker is mounted in each of said walls with the driver axes being coaxial. The enclosure means may include two enclosure portions having connection means connecting said portions. The loudspeakers may be facing away from each other or facing toward each other.

It is yet another aspect of this invention to provide a loudspeaker system where the interior walls provide the spaced walls.

It is an aspect of this invention that the enclosure means includes opposed pairs of longitudinal walls, connecting said spaced walls, and said spaced walls are transversely disposed to said longitudinal walls.

It is another aspect of this invention that the loudspeakers are facing toward each other, and a port tube is mounted in one of said longitudinal walls between said spaced walls.

Another aspect of this invention is to provide a loudspeaker system where said enclosure means is in the form of a regular prism and includes a plurality of longitudinal walls and each loudspeaker is mounted in a longitudinal wall such that the axes of the loudspeakers intersect at a point.

Still another aspect of the invention is to provide a loudspeaker system in which the enclosure is in the form of a triangular pyramid having four walls and a loudspeaker is mounted in each wall such that the axes of said loudspeakers intersect at a point.

It is another aspect of this invention to provide a loudspeaker system having an enclosure means which may be free standing or may be mounted in a room within a wall, floor or ceiling.

It is an aspect of this invention to provide a loudspeaker system which is relatively inexpensive and simple to manufacture and can be freestanding or easily installed in walls, floor or ceiling.

DESCRIPTION OF THE PREFERRED EMBODIMENT

Figure 1:
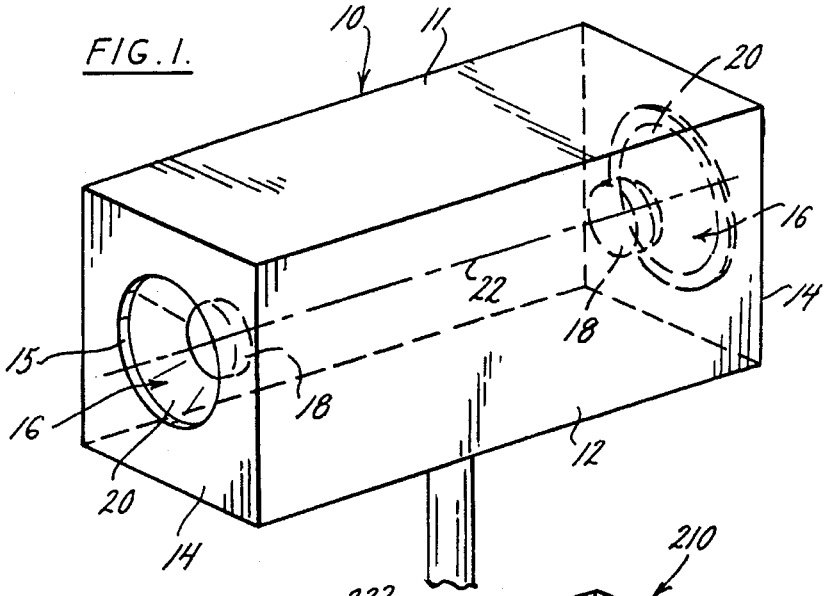
FIG. 1 is a perspective view of a loudspeaker system having a rectangular enclosure.

Referring now by reference numerals to the drawings and first to FIG. 1 it will be understood that a rectangular speaker enclosure portion 10 is shown having two pairs of opposed longitudinal side walls 11, 12 and opposed end walls 14. The end walls 14 include openings 15 for mounting loudspeakers 16, each loudspeaker having a driver portion 18 with a longitudinal axis and a cone portion 20. The loudspeakers are arranged coaxially with the drivers facing toward each other so that the driver axes are arranged on a common axis 22. The loudspeaker cone portions 20 move forward, or away from each other, in this configuration and the loudspeaker enclosure portion 10 is subjected alternately to tension and compression forces by the speakers 16. Since the cones are moving in opposite directions, there is an equal but opposite reaction on the enclosure 10 from the two speakers 16 on the common axis 22. If the enclosure 10 were perfectly rigid, the sum of the two forces would be zero since they would cancel each other out and the enclosure would not vibrate at all. Wood is one of the more rigid materials commonly used for forming the enclosure 10, though it is not perfectly stiff and, with the arrangement described above, there are minimal vibrations but at significantly lower amplitudes than with conventional loudspeaker systems. The loudspeaker in FIG. 1 has enclosure accelerations less than 0.2 gee, compared to conventional loudspeaker systems with enclosure accelerations of more than 1.0 gee. This enclosure can be free-standing, as shown, or it can be recessed in a room without vibrating the house or disturbing people in other rooms because the subwoofer moves the air but not the enclosure or the floor, wall or ceiling where it is installed.

Figure 2:
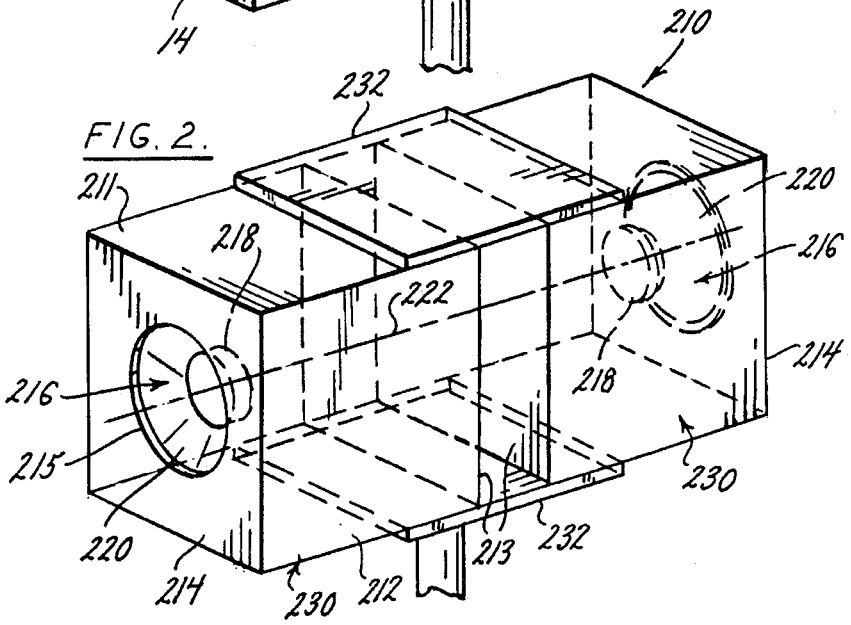
FIG. 2 is a perspective view of a modified loudspeaker system having two enclosures tied together.

FIG. 2 is a modified loudspeaker arrangement of a rectangular speaker enclosure portion 210 having two speaker enclosure portions 230 connected by connector means, such as opposed plates 232, providing a space therebetween. The enclosure is shown as freestanding but could also be recessed in a room. Each speaker enclosure portion 230 has two pairs of opposed side walls 211, 212 and opposed end walls 213, 214. The end wall 213 on each portion includes an opening 215 for mounting loudspeakers 216, each loudspeaker having a driver portion 218 and a cone portion 220. The loudspeakers are arranged coaxially with the drivers facing toward each other so that the driver axes are arranged on a common axis 222. The connector plates 232 connect the two speaker enclosure portions 230 on the outside of the enclosure 210 and provide the positioning of the two speaker enclosure portions to insure a common axis 222.

Figure 3:
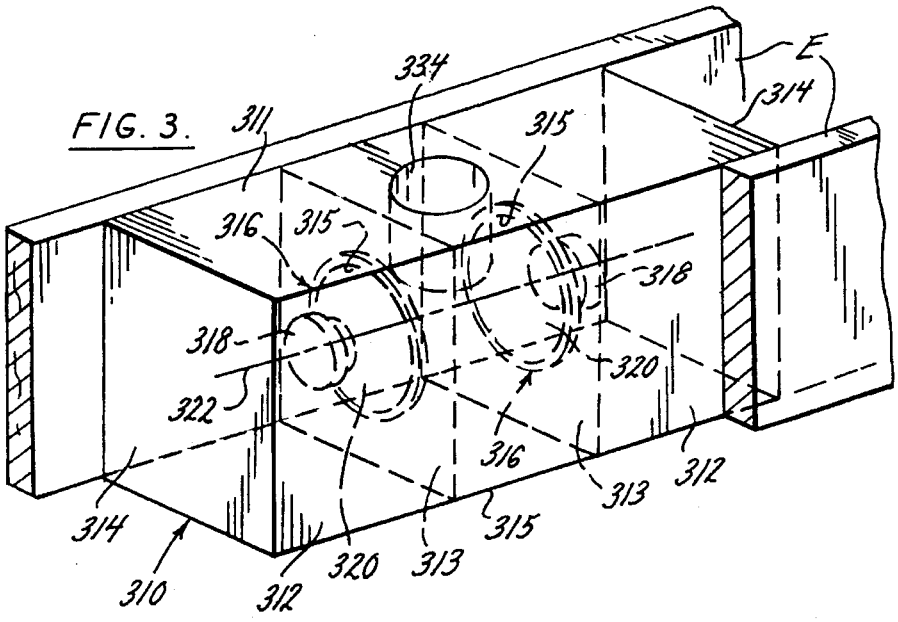
FIG. 3 is a perspective view of another modified loudspeaker system having a three-chambered enclosure.

In FIG. 3 there is shown another modified arrangement of a rectangular speaker enclosure portion 310 having generally two pairs of opposed side walls 311, 312 and opposed end walls 314. In this embodiment the enclosure is shown mounted between floor beams E. There are two partitions 313 defining three chambers within the speaker enclosure portion 310. The partitions 313 include openings 315 for mounting loudspeakers 316, each loudspeaker having a driver portion 318 and a cone portion 320. The loudspeakers are arranged coaxially with the drivers facing away from each other and so that the driver axes are arranged on a common axis 322. In the embodiment shown there is a port tube 334 located in the center chamber and mounted in one of the side walls 311 providing a means for transmitting sound outside of the enclosure 310 through a floor grill (not shown). It will be understood that the loudspeakers 316 could also be arranged coaxially with the drivers facing toward each other as long as the driver axes are arranged on a common axis 322. Port tubes 336 could then be located in each of the two end chambers and mounted in a side wall 312 or the opposed end walls 314.

The loudspeaker system forming the present invention also lends itself to mounting in an enclosure having the form of a prism having parallel longitudinal sides and being a regular polygon in cross section, the speakers being mounted in the longitudinal sidewalls.

Figure 4:
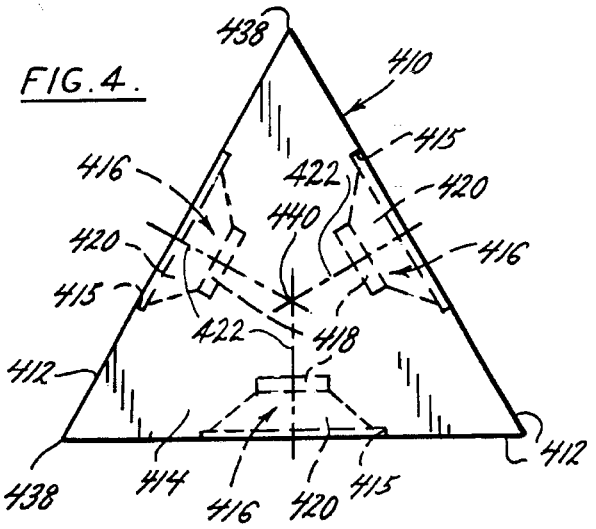
FIG. 4 is a plan view of another modified loudspeaker system with an enclosure having the form of an equilateral triangular prism.

Referring to FIG. 4 there is shown an equilateral triangular prism speaker enclosure portion 410 having three substantially identical side walls 412 and opposed end walls 414, two side walls 412 forming common edges 438. The side walls 412 include openings 415 for mounting loudspeakers 416, each loudspeaker having a driver portion 418 and a cone portion 420. A loudspeaker 416 is disposed on each side wall 412 equidistant between the two edges 438 of each side wall and each loudspeaker 416 is located the same distance as the other loudspeakers between the opposed end walls 414.

Figure 5:
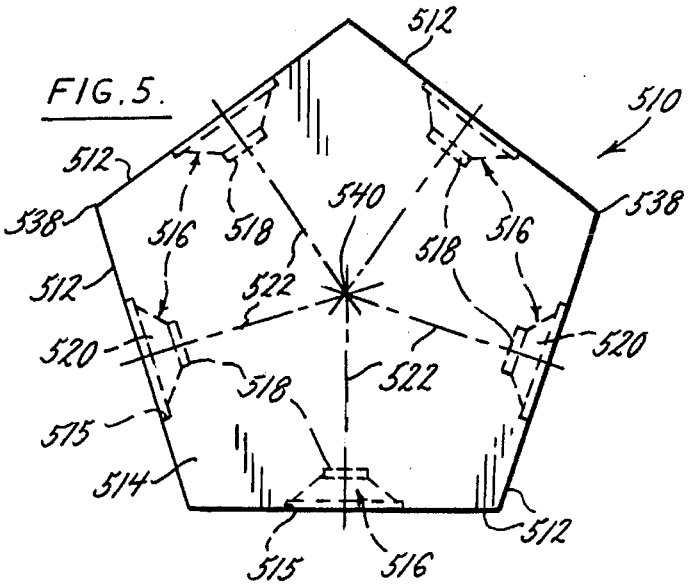
FIG. 5 is a plan view of another modified loudspeaker system with an enclosure having the form of a pentagonal prism.

The modified loudspeaker assembly shown in FIG. 5 is a pentagonal prism speaker enclosure portion 510 having five substantially identical side walls 512 and opposed end walls 514, two side walls 512 forming common edges 538. The side walls 512 include openings 515 for mounting loudspeakers 516, each loudspeaker having a driver portion 518 and a cone portion 520. A loudspeaker 516 is disposed on each side wall 512 equidistant between the two edges 538 of each side wall and each loudspeaker 516 is located the same distance as the other two loudspeakers between the opposed end walls 514.

In FIGS. 4 and 5, the axis of each driver 422, 522 is perpendicular to the side walls and in a plane common to the axis of each other driver. The axis of each driver 422, 522 intersects the axis of the other drivers at a common point 440, 540 and this point is equidistant from each driver 418, 518. In this configuration the vector sum of the vibrational forces is zero, providing a substantially vibrationless loudspeaker system.

Although FIGS. 4 and 5 show enclosures having an odd number of side walls the enclosure could have an equal number of side walls. For example, a hexagonal prism could be used. Also, with an even number of side walls loudspeakers could be mounted in every other side wall with the axes intersecting at a point. The enclosure could also be in the form of a cylinder with loudspeakers mounted at circumferentially equal intervals and the driver axes intersecting at a point on the longitudinal axis of the cylinder.

In the arrangement shown in FIGS. 4 and 5, the loudspeakers could all be facing away from or toward each other. If the loudspeakers are arranged with the drivers 418, 518 away from each other, then a port tube could be mounted in at least one end wall 414, 514 to transmit sound outside of the enclosure.

Figure 6:
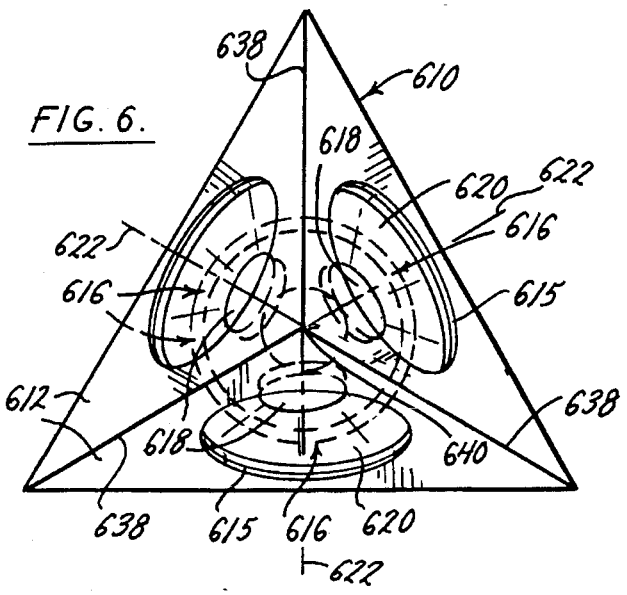
FIG. 6 is a plan view of another modified loudspeaker system with an enclosure having the form of a four-sided pyramid.

In the embodiment shown in FIG. 6 the modified arrangement is of a four-sided pyramid enclosure 610 having four substantially identical side walls 612 in the form of equilateral triangles and six edges 638, two side walls forming a common edge. The side walls 612 include openings 615 for mounting loudspeakers 616, each loudspeaker having a driver portion 618 and a cone portion 620. The loudspeakers are mounted in all four side walls 612 and arranged with the drivers 618 facing toward each other so that the driver axes 622, the axes being perpendicular to the associated side walls, intersect at a common point 640. The axes 622 of all the drivers will not lie in a common plane, but the point 640 will be in the center of the pyramid and the vector sum of the forces will be zero.

In addition to being freestanding or wall mounted the loudspeaker enclosures can be suspended at the end of a hanger.

In view of the above it will be seen that various aspects and features of the invention are achieved and other advantageous results attained. While preferred embodiments of the invention have been shown and described, it will be obvious to those skilled in the art that changes and modifications may be made therein without departing from the invention in its broader aspects.

I claim as my invention:

1. A loudspeaker system comprising:

a) enclosure means including a plurality of longitudinally extending walls and a pair of spaced transversely disposed interior walls having port means disposed therebetween in parallel relation to said transversely spaced walls and having a predetermined size;

b) a pair of loudspeakers each including a driver and a diaphragm and having longitudinal axis substantially perpendicular to said interior walls; and c) the loudspeaker being mounted to associated interior walls in the enclosure means facing toward each other such that the axis of the drivers are arranged coaxially relative to each other so that the vector sum of the driver forces is substantially zero and vibration of the enclosure means is substantially reduced, the loudspeaker diaphragms being spaced apart a distance at least as great as the size of the port means between the interior walls.

2. A loudspeaker system as defined in claim 1, in which:

d) the enclosure means includes opposed paris of longitudinal walls and is mounted in a room within a wall, floor or ceiling, and e) one of the longitudinal walls is disposed adjacent said room and the port means is a tubular port and includes exit means through only that wall and into said room.

* * * * *